US005576683A

United States Patent [19]

Rose

[11] Patent Number: 5,576,683

[45] Date of Patent: Nov. 19, 1996

[54] THERMOSTAT WITH THERMAL INSULATOR FOR PROTECTION AGAINST OVERHEATING

[75] Inventor: Derek J. Rose, Mansfield, Ohio

[73] Assignee: Therm-O-Disc, Incorporated, Mansfield, Ohio

[21] Appl. No.: 489,844

[22] Filed: Jun. 13, 1995

[51] Int. Cl.[6] ..... H01H 37/52; H01H 61/02

[52] U.S. Cl. ..... 337/333; 337/107; 337/354

[58] Field of Search ..... 337/102–107, 337/354, 333, 377; 29/623

[56] References Cited

U.S. PATENT DOCUMENTS 4,533,894 8/1985 Bishop et al. ..... 337/107

4,646,051 2/1987 Ruszczyk et al. ..... 337/107

*Primary Examiner*—Leo P. Picard
*Assistant Examiner*—Jayprakash N. Gandhi
*Attorney, Agent, or Firm*—Jones, Day, Reavis & Pogue

[57] ABSTRACT

An electrical resistance heater is positioned adjacent to a bimetal disc in a thermostat for depressing the temperatures at which the disc snaps between oppositely bowed positions to open and close a switch. A thermal insulator interposed between the heater and the thermostat housing protects the housing against overheating and properly locates the heater relative to the disc. A dielectric film on the surface of the disc that faces toward the heater insures adequate electrical spacing between the heater and disc.

8 Claims, 3 Drawing Sheets

THERMOSTAT WITH THERMAL INSULATOR FOR PROTECTION AGAINST OVERHEATING

BACKGROUND OF THE INVENTION

This application relates to the art of thermostats and, more particularly, to thermostats having internal heaters for supplying auxiliary heat to a bimetal disc and thereby making the thermostat responsive to lower external temperatures. The invention is particularly applicable to thermostats that have a bimetal disc for operating a single pole single throw switch and will be described with specific reference thereto. However, it will be appreciated that the invention has broader aspects and can be used in other types of thermostats.

U.S. Pat. No. 4,533,894 issued Aug. 6, 1985, discloses a thermostat having internal heaters for providing temperature depression. The arrangement described in the patent provides temperature depression up to a maximum of about 15° F. because the thermal rating of the plastic thermostat housing limits the amount of heat output from the internal heaters that can be tolerated. Electrical spacing requirements also prevent location of the heaters too close to the bimetal disc. It would be desirable to have a thermostat of the type described that was capable of significantly greater temperature depression than about 15° F. and that could have the internal heaters positioned extremely close to the bimetal disc.

SUMMARY OF THE INVENTION

A thermostat of the type described has a thermal insulator positioned between the heaters and the thermostat housing. The heaters are positioned closely adjacent the bimetal disc and adequate electrical spacing is provided by a plastic film on the surface of the disc that faces toward the heaters. These arrangements provide temperature depression up to about 30° F.

In a preferred arrangement, the thermal insulator is also a spacer that properly locates the internal heaters with respect to the other thermostat components.

It is a principal object of the present invention to provide a thermostat having internal heaters that are capable of providing temperature depression up to about 30° F.

It is also an object of the invention to provide a thermostat with a thermal insulator interposed between internal heaters and the thermostat housing.

It is a further object of the invention to provide a thermostat with a plastic film on the surface of a bimetal disc that faces toward internal heaters for allowing the heaters to be located closer to the bimetal without violating electrical spacing requirements.

DESCRIPTION OF A PREFERRED EMBODIMENT

Figure 1:
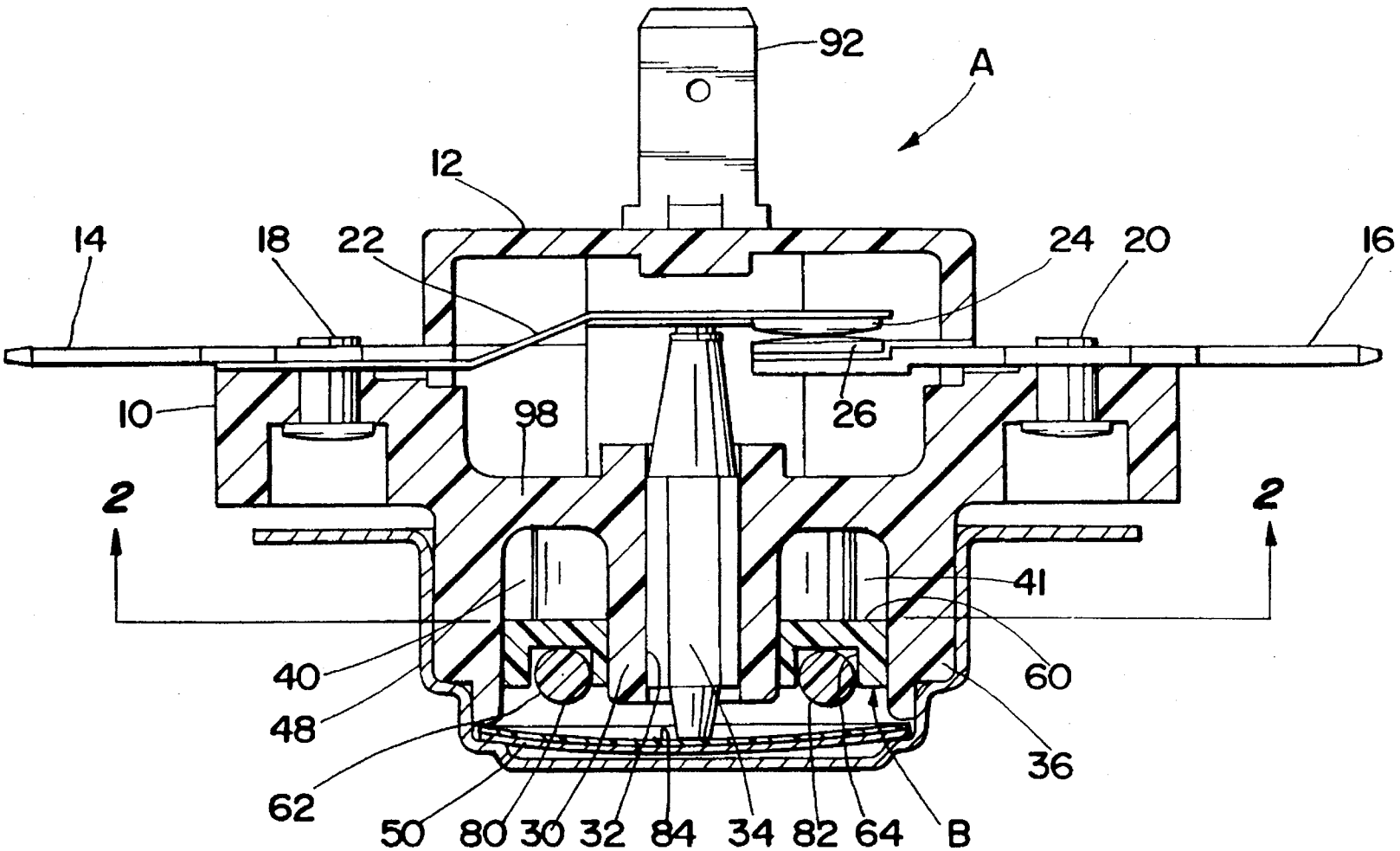
FIG. 1 is a cross-sectional elevational view of a thermostat having the improvements of the present application incorporated therein.

Referring now to the drawing, wherein the showings are for purposes of illustrating a preferred embodiment of the invention only and not for purposes of limiting same, FIG. 1 shows a thermostat A having a dielectric plastic housing that includes a housing base 10 and a cover 12. Switch terminals 14, 16 are attached to housing base 10 by rivets 18, 20. A movable spring blade 22 carries a movable switch contact 24, and is attached to both switch terminal 14 and housing base 10 by rivet 18. Switch terminal 16 carries a fixed switch contact 26.

Housing base 10 has a central elongated sleeve 30 with an internal passage 32 receiving a reciprocating plunger 34 aligned with switchblade 22. An annular cavity is defined between sleeve 30 and housing base peripheral wall 36. Circumferentially-spaced radial ribs 40–43 extend between sleeve 30 and peripheral wall 36 for adding support to sleeve 30. Ribs 40–43 have a height that is approximately one-half of the depth of the annular cavity between sleeve 30 and housing base peripheral wall 36.

A metal disc cup 48 secured to housing base peripheral wall 36 supports a bimetal disc 50 that cooperates with reciprocating plunger 34 for opening and closing switch contacts 24, 26. When a predetermined elevated temperature is reached, disc 50 snaps from the position shown in FIG. 1 to an oppositely bowed position and moves plunger 34 upwardly to bend switch arm 22 and move contact 24 away from fixed contact 26. When a predetermined lower temperature is reached, bimetal disc 50 will snap back to the bowed position shown in FIG. 1 and the spring force of switch arm 22 will move contact 24 back into engagement with contact 26.

Thermostatic switches of the type described are commonly provided with internal heaters for depressing the temperatures at which the bimetal disc snaps between switch open and switch closed positions. By way of example, say that a given thermostat snaps to a switch open position at an externally sensed temperature of about 150° F. and snaps back to a switch closed position at an externally sensed temperature of about 130° F. Existing arrangements allow depression of these temperatures as much as about 15° F. by adding internal heaters to the thermostat for heating the bimetal disc. With the heaters energized, the disc will snap to a switch open position at an external temperature of about 135° F. and will snap back to a switch closed position at an external temperature of about 115° F. Temperature depression greater than about 15° F. is not possible because the internal heaters necessary to produce the required heat would also cause the thermal limits of the thermostat housing to be exceeded.

In accordance with the present application, temperature depression as great as about 30° F. is achieved by placing a thermal insulator between the heaters and the thermostat housing, and by locating the heaters closer to the bimetal disc while providing adequate electrical spacing by placing a dielectric film on the bimetal disc surface that faces toward the heaters.

In the example given above for a thermostat that operates to open a switch at an externally sensed temperature of about 150° F. and operates to close the switch at an externally sensed temperature of about 130° F., the improvement of the present application allows temperature depression up to about 30° F. so that the thermostat will operate to open the switch at an externally sensed temperature of about 120° F. and will operate to close the switch at an externally sensed temperature of about 100° F.

The improved arrangement of the present application also makes it possible to provide thermostat calibration temperatures higher than presently available. In the example given for a thermostat that operates to open the switch at a temperature of about 150° F., the addition of the improvements of the present application make it possible to calibrate such a thermostat for a temperature as high as 180° F.

Figure 4:
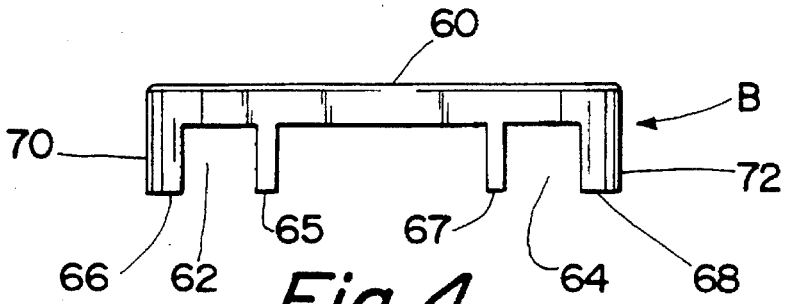
FIG. 4 is an end elevational view of a thermal insulator.
Figure 5:
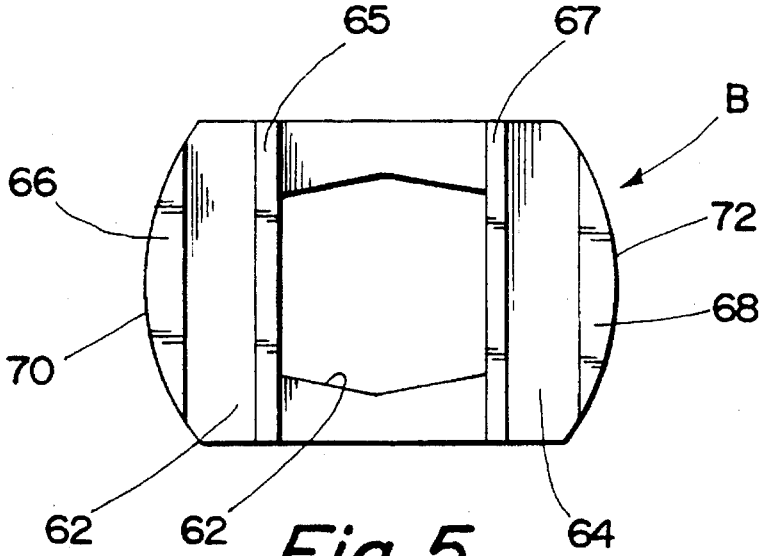
FIG. 5 is a bottom view of the thermal insulator of FIG. 4.
Figure 6:
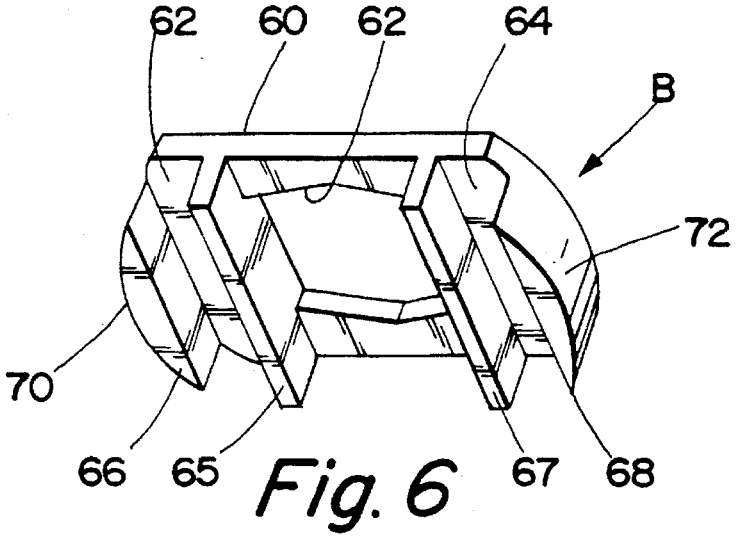
FIG. 6 is a perspective illustration of the thermal insulator of FIGS. 4 and 5.

FIGS. 4–6 show a thermal insulator B having a flat top surface 60 and a central opening 62 for closely receiving sleeve 30 in housing base 10. Thermal insulator B has a pair of spaced-apart parallel grooves 62, 64 outwardly of central opening 62 defined between inner and outer walls 65, 66 and 67, 68. Outer surfaces 70, 72 of outer walls 66, 68 are curved to lie on the periphery of a cylinder that is approximately the same size as the outer periphery of the annular recess between sleeve 30 and housing base peripheral wall 36.

Thermal insulator B is positioned in the annular cavity between sleeve 30 and housing peripheral wall 36 as shown in FIG. 1. Thermal insulator B bears against ribs 40–43 for properly locating the thermal insulator within the housing base. Electrical resistance heaters 80, 82 are received in grooves 62, 64 of thermal insulator B. The spacing between heaters 80, 82 and bimetal disc 50 is closer than 1/16 inch and a polyamide film 84 is placed on the surface of disc 50 that faces toward the heaters to provide adequate electrical spacing. The polyamide film 84 has a thickness of about 0.005 inch to provide adequate electrical insulation without materially inhibiting heat transfer from the heaters to the bimetal disc. The thermal limit of film 84 is also much higher than that of the thermostat housing, such as about 450° F.

Figure 2:
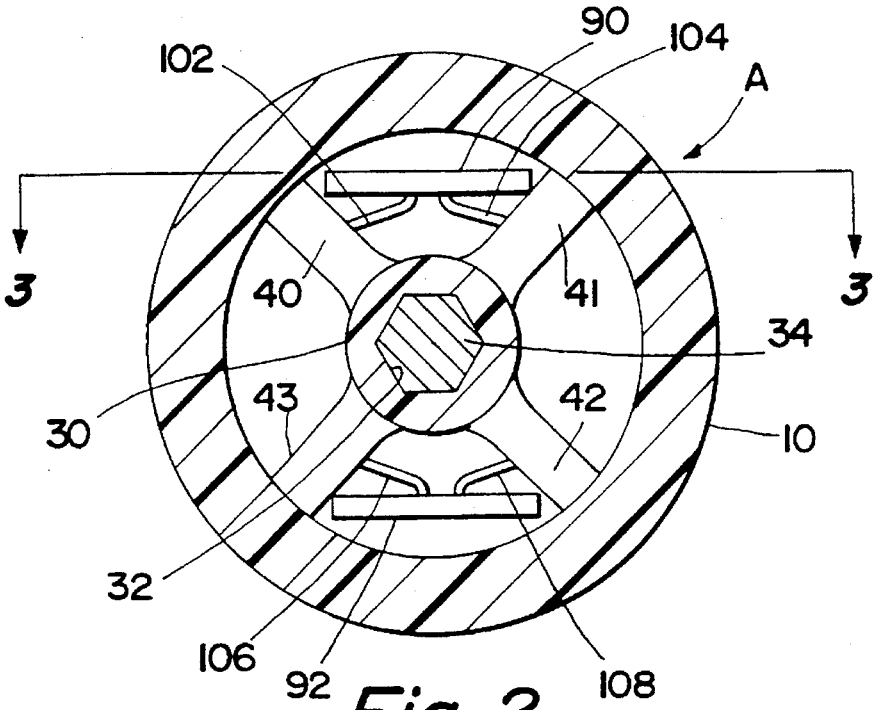
FIG. 2 is a cross-sectional plan view taken generally on line 2—2 of FIG. 1.
Figure 3:
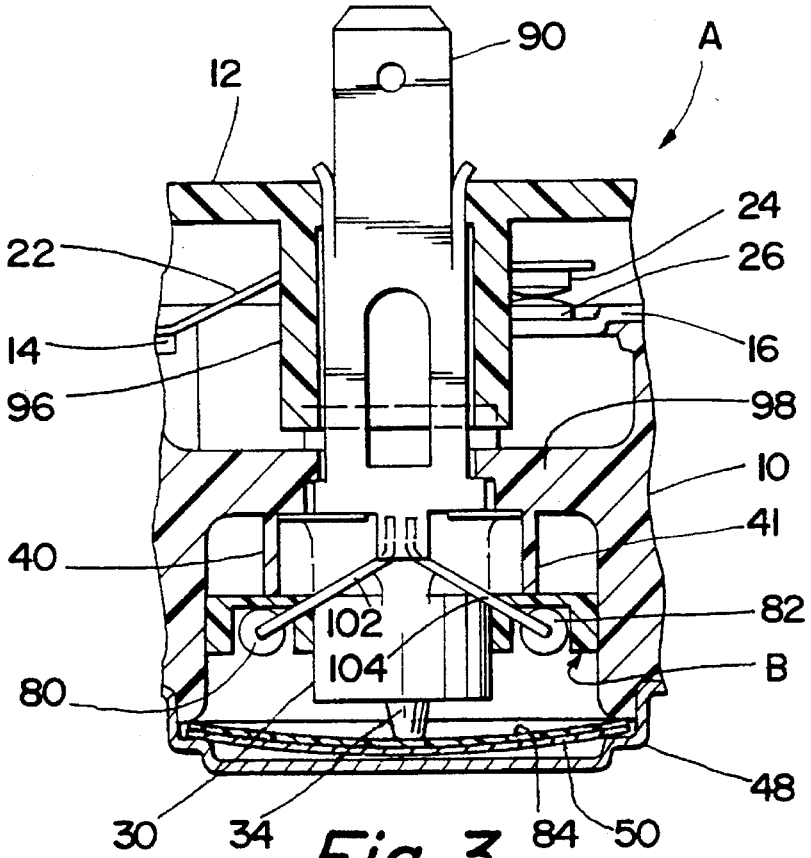
FIG. 3 is a cross-sectional elevational view taken generally on line 3—3 of FIG. 2.

Electrical resistance heater terminals 90, 92 extend through housing cover 12. With reference to FIG. 3, heater terminal 90 extends through a passage in a cover guide sleeve 96 and through a suitable passage in a horizontal divider wall 98 in housing base 10 that separates the switch chamber from the annular cavity that receives thermal insulator B. One surface of divider wall 98 forms the bottom of the annular cavity between sleeve 30 and peripheral wall 36, and ribs 40–43 extend from such bottom over about one-half of the depth of the annular cavity. Electrical leads 102, 104 on heaters 80, 82 are welded or otherwise suitably secured to terminal 90 as shown in FIG. 3. Additional leads 106, 108 at the opposite ends of heaters 80, 82 are attached to heater terminal 92 as shown in FIG. 2.

When thermal insulator B is bottomed out against ribs 40–43, the bottoms of grooves 62, 64 are located such that heaters 80, 82 will be properly positioned and spaced from disc 50 when they are placed against the bottoms of the grooves. The leads on heaters 80, 82 are welded to terminals 90, 92 to form a heaters/terminal subassembly. With thermal insulator B positioned against ribs 40–43, the heater/terminal subassembly as installed by passing terminals 90, 92 through the openings in housing base 10 and cower 12 until heaters 80, 82 engage the bottoms of thermal insulator grooves 62, 64. Terminals 90, 92 are then crimped or otherwise deformed outside of cover 12. This holds heaters 80, 82 against the bottoms of grooves 62, 64, and holds thermal insulator B against ribs 40–43.

Although many different materials may be used for the thermostat housing and the thermal insulator, typical examples will be given simply by way of illustration. The thermostat housing may be of a phenolic plastic material having a thermal limit of about 350° F. Thermal insulator B is made of a polyphenylene sulfide having a thermal limit of about 440° F. Heaters 80, 82 have greater heat output than previous arrangements for significantly increasing the temperature depression that is possible. Thermal insulator B protects housing base 10 against overheating while plastic film 84 on disc 50 provides adequate electrical spacing even though the heaters are located extremely close to the bimetal disc.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. A thermostat including a housing having a disc chamber receiving a bimetal disc, said housing including a dielectric body having a cavity facing said bimetal disc, an electric resistance heater in said cavity adjacent said disc, and a thermal insulator interposed between said heater and said body.

2. The thermostat of claim 1 including a dielectric material between said heater and said bimetal disc.

3. The thermostat of claim 1 wherein said bimetal disc snaps in opposite switch opening and closing directions, and the temperatures at which said disc snaps in said opposite directions when said heater is energized is at least about 30° F. less than the temperatures at which said disc snaps in said opposite directions when said heater is deenergized.

4. The thermostat of claim 1 wherein said thermal insulator comprises a heater spacer and positioning member for spacing said heater from said housing body and for positioning said heater in a desired location relative to said bimetal disc.

5. The thermostat of claim 1 wherein said body includes a central bumper guide surrounded by said cavity, said cavity having a bottom, a plurality of circumferentially-spaced ribs spanning said cavity adjacent said bottom thereof for supporting said bumper guide, and said thermal insulator being positioned against said ribs.

6. The thermostat of claim 1 wherein said resistance heater comprises a pair of opposite resistance heaters and said thermal insulator has a pair of opposite grooves receiving said pair of resistance heaters.

7. A thermostat having a bumper between a switch and a bimetal snap disc for moving said switch between open and closed positions responsive to snap movements of said disc between oppositely bowed conditions, said disc being snapable in one direction at a first predetermined temperature to open said switch and being snapable in an opposite direction at a lower second predetermined temperature to close said switch, said thermostat including a dielectric housing body having an internal cavity adjacent said disc, an electrical resistance heater in said cavity adjacent said disc for reducing both of said first and second predetermined temperatures by at least about 30° F., and a thermal insulator interposed between said dielectric housing body and said heater.

8. The thermostat of claim 7 including a dielectric film on said disc facing said heater.

* * * * *